US010111792B2

(12) United States Patent
Lai et al.

(10) Patent No.: US 10,111,792 B2
(45) Date of Patent: Oct. 30, 2018

(54) MULTIFUNCTIONAL NURSING BED FOR EXCRETION

(71) Applicants: Cheng-Piao Lai, Taoyuan (TW); Ting-Yu Lai, Taoyuan (TW)

(72) Inventors: Cheng-Piao Lai, Taoyuan (TW); Ting-Yu Lai, Taoyuan (TW)

( * ) Notice: Subject to any disclaimer, the term of this patent is extended or adjusted under 35 U.S.C. 154(b) by 389 days.

(21) Appl. No.: 15/011,769

(22) Filed: Feb. 1, 2016

(65) Prior Publication Data

US 2017/0216116 A1 Aug. 3, 2017

(51) Int. Cl.

| | |
|---|---|
| ***A61G 7/02*** | (2006.01) |
| ***A61G 7/018*** | (2006.01) |
| ***A61G 7/012*** | (2006.01) |
| ***A61G 7/05*** | (2006.01) |
| ***A61G 7/015*** | (2006.01) |
| ***A47C 21/04*** | (2006.01) |
| ***A61G 7/00*** | (2006.01) |

(52) U.S. Cl.

CPC ..... *A61G 7/02* (2013.01); *A47C 21/044* (2013.01); *A61G 7/0005* (2013.01); *A61G 7/012* (2013.01); *A61G 7/015* (2013.01); *A61G 7/018* (2013.01); *A61G 7/05* (2013.01)

(58) Field of Classification Search

CPC ..... A47C 21/044; A61G 5/1002; A61G 7/02; A61G 7/015; A61G 7/05; A61G 7/018; A61G 7/0005; A61G 7/012

See application file for complete search history.

(56) References Cited

U.S. PATENT DOCUMENTS

| | | | | | |
|---|---|---|---|---|---|
| 1,525,605 | A * | 2/1925 | Dry | A61G 7/02 | 5/503.1 |
| 1,697,027 | A * | 1/1929 | Stevenson | A47C 21/00 | 160/334 |
| 3,345,652 | A * | 10/1967 | Hiraga | A61G 7/02 | 12/142 R |
| 3,701,170 | A * | 10/1972 | Bond | A47K 3/001 | 4/570 |
| 3,889,910 | A * | 6/1975 | Walters | A47B 23/007 | 248/122.1 |
| 3,943,583 | A * | 3/1976 | Ishikawa | A61G 7/02 | 4/144.1 |
| 4,007,501 | A * | 2/1977 | Kato | A61G 7/02 | 4/144.3 |
| 4,982,462 | A * | 1/1991 | Wada | A61G 7/0005 | 4/546 |
| 5,054,136 | A * | 10/1991 | Inagaki | A61G 7/0005 | 4/546 |
| 5,077,845 | A * | 1/1992 | Tokunaga | A61G 7/02 | 4/237 |

(Continued)

*Primary Examiner* — Nicholas F Polito

(74) *Attorney, Agent, or Firm* — Rosenberg, Klein & Lee

(57) ABSTRACT

A multifunctional nursing bed for excretion includes a bed frame, a board, two elevation devices, an excretion device, a washing device, an anti-splash device, a cover device, and a control device electrically connected to the mentioned devices for operation. When a user has a need for excretion, the control device turns on the elevation devices to elevate the board and the cover device is elevated and opened. Then descending the board and pressing the cover device for descending as well, for the anti-splash device to be elevated and ready for use, whereby the user is able to perform excretion directly on the nursing bed without any help from others.

10 Claims, 20 Drawing Sheets

(56) References Cited

U.S. PATENT DOCUMENTS

| | | | | | |
|---|---|---|---|---|---|
| 5,235,712 | A * | 8/1993 | Smith | A61G 7/0005 | 4/585 |
| 5,345,629 | A * | 9/1994 | Ferrand | A61G 7/00 | 5/185 |
| 5,351,349 | A * | 10/1994 | Tsai | A61G 7/02 | 5/604 |
| 6,003,950 | A * | 12/1999 | Larsson | A47C 7/74 | 297/180.13 |
| 6,848,133 | B2 * | 2/2005 | Tanaka | A61G 7/02 | 4/300.2 |
| 7,857,265 | B1 * | 12/2010 | Adkisson | A47C 21/003 | 248/125.7 |
| 8,408,504 | B1 * | 4/2013 | Gonzales | A47B 23/02 | 248/158 |
| 9,622,588 | B2 * | 4/2017 | Brykalski | A47C 21/04 | |
| 2004/0090093 | A1 * | 5/2004 | Kamiya | B60N 2/5628 | 297/180.14 |
| 2006/0282944 | A1 * | 12/2006 | Sagi | A61G 7/0005 | 4/585 |
| 2008/0256708 | A1 * | 10/2008 | Park | A61G 7/02 | 5/605 |
| 2010/0083441 | A1 * | 4/2010 | Ishida | A61G 7/002 | 5/604 |

* cited by examiner

MULTIFUNCTIONAL NURSING BED FOR EXCRETION

BACKGROUND OF THE INVENTION

1. Field of the Invention

The present invention relates to a multifunctional nursing bed for excretion, particularly to one that allows its user to perform excretion thereon.

2. Description of the Related Art

As population aging becomes more serious, many illnesses that tend to happen to elders are more common such as strokes, brain diseases, paralysis, central nervous system damages, and other illnesses. These illnesses cause a person to lie on a bed for most of the time, and require the families and nursing personnel's full attention and strength for caring. And when it comes to daily routine like excretion and bathing, it is inconvenient and even self-esteem hurting. The patients have to rely on others' help to go to the bath room; many of them also have a simple tool for urinate at bedsides. Such situations are tiring for the caregivers and even more embarrassing and mentally burdening for the patients.

Therefore, it is desired to provide a nursing bed with practical functions that is able to solve the problems disclosed above.

SUMMARY OF THE INVENTION

A primary object of the present invention is to provide a multifunctional nursing bed for excretion that allows its user to perform excretion thereon without moving or helps from others, achieving conveniences and reducing troubles for the user.

Another object of the present invention is to provide a multifunctional nursing bed for excretion that allows people who had a stroke, aged people, paralyzed or vegetative patients to bathe directly thereon for more conveniences.

To achieve the objects mentioned above, the present invention comprises a bed frame including a head board connecting a foot board with a plurality of side supports in-between; a board disposed on the bed frame between the head board and the foot board, including at least one first panel and one second panel, both ends of an abutting side of said first and second panels having a rotatable linkage point for angle adjusting between the first and second panels; a first elevation device disposed under the first panel for supporting and adjusting an elevation of the first panel; a second elevation device disposed under the second panel for supporting and adjusting an elevation of the second panel and an angle between the first and second panels; wherein the first panel includes a first through hole corresponding to a position of buttocks of human body; an excretion device arranged below the first through hole, including a basin, a seat pad disposed on a surface of the basin, and a detachable container disposed below the basin for taking the falling wastes; a washing device including a first tube connecting to said excretion device with an end and to a first pump with the other end, said first pump including a first suction tube to suck in water from a tank for washing the excretion device; an anti-splash device disposed at a front of the excretion device, including a placing space, an anti-splash cover disposed in said placing space with a gear rack arranged behind for operation, and a first motor arranged aside said placing space for driving a gear that engages said gear rack for elevation and descending; a cover device arranged between the excretion device and the first panel, including a cover disposed above the seat pad and composed of a left board and a right board, a first sliding rail, and a second sliding rail; said sliding rails being parallel arranged and respectively fixed at a front and a rear side of the cover by an engaging element for the left and right boards to slide along the first and second sliding rails to combine with and detach from each other; at both ends of said sliding rails, a vertical guiding rod being engaged with a spring in-between and the other end devoid of spring stretching through the side supports for elastically elevation of the washing device and for pressing and lowering said cover device to a position where the cover being in the first through hole when the board being descended; two driver assemblies symmetrically arranged at corresponding far sides of the first and second sliding rails, respectively including a second motor and a third motor for respectively driving a first threaded rod and a second threaded rod, on each of which a nut is arranged for respectively engaging and driving the right board and the left board; and a control device individually connected to the first elevation device, the second elevation device, the first pump, and the first, second and third motors, and having an operation interface for operation control; whereby upon a patient on the nursing bed having a need for excretion, the control device drives the first and second elevation devices to elevate the board and the cover device is elevated as well, then the board descends back to an original position after the cover of the cover device is opened, pressing the cover device for descending and placing the seat pad of the excretion device right under the first through hole with the anti-splash cover of the anti-splash device elevated for being ready for use.

With structures disclosed above, the board has a plurality of ventilation holes with a mattress made of air-permeable materials placed thereon, and at least one fan arranged under the board for ventilation. The mattress further includes a second through hole corresponding to the first through hole on the first panel of the board.

Furthermore, the basin of the excretion device has an exit at the center thereof with a seesaw device arranged thereunder. The seesaw device includes a movable board linked to a counterweight by a pivot arranged at a rear periphery of the exit to close the exit in normal status and to guide the wastes falling down to the container when needed.

The washing device further includes a second tube that has an end thereof linked to the excretion device and the other end thereof linked to a second pump, said second pump linking to a second suction tube to suck in water from the tank for washing the excretion device, and an air tube having an end thereof linking to the excretion device and the other end thereof linking to a dryer for drying.

The present invention further comprises an electrical heater arranged on the side supports, including a body linked to an end of a third tube and a showerhead, and the other end of the third tube is linked to a third pump with a third suction tube for sucking in water from the tank and heating up the water before discharging from the showerhead.

As structures disclosed above, the present invention is designed for those have to lie on a bed for most of the time, usually patients. With the nursing bed, a user is able to perform excretion and bathe with more conveniences without relying on others' helps, therefore regaining some self-esteem as well. Also, such invention helps with better hygiene.

DETAILED DESCRIPTION OF THE PREFERRED EMBODIMENT

Figure 1:
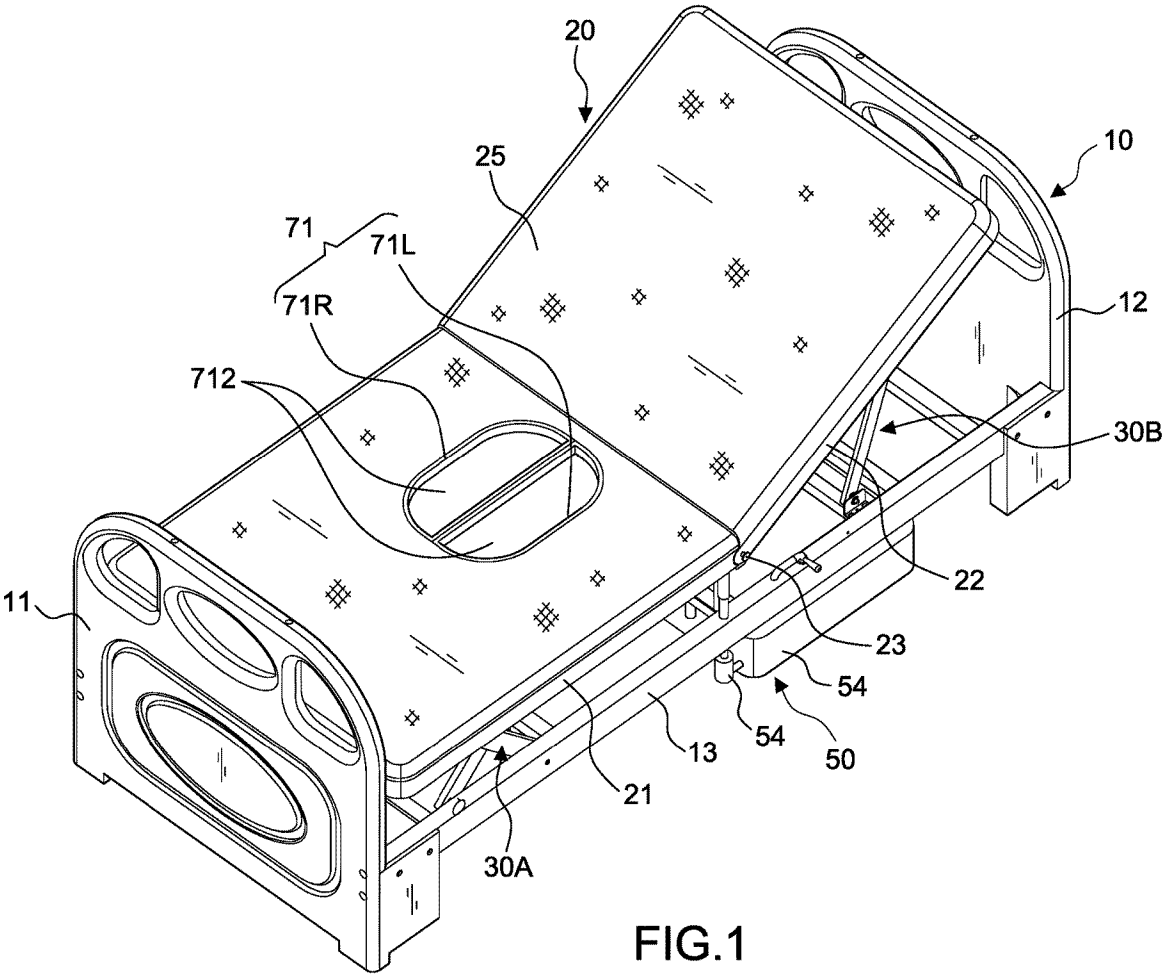
FIG. 1 is a perspective view of the present invention in a preferred embodiment.
Figure 1A:
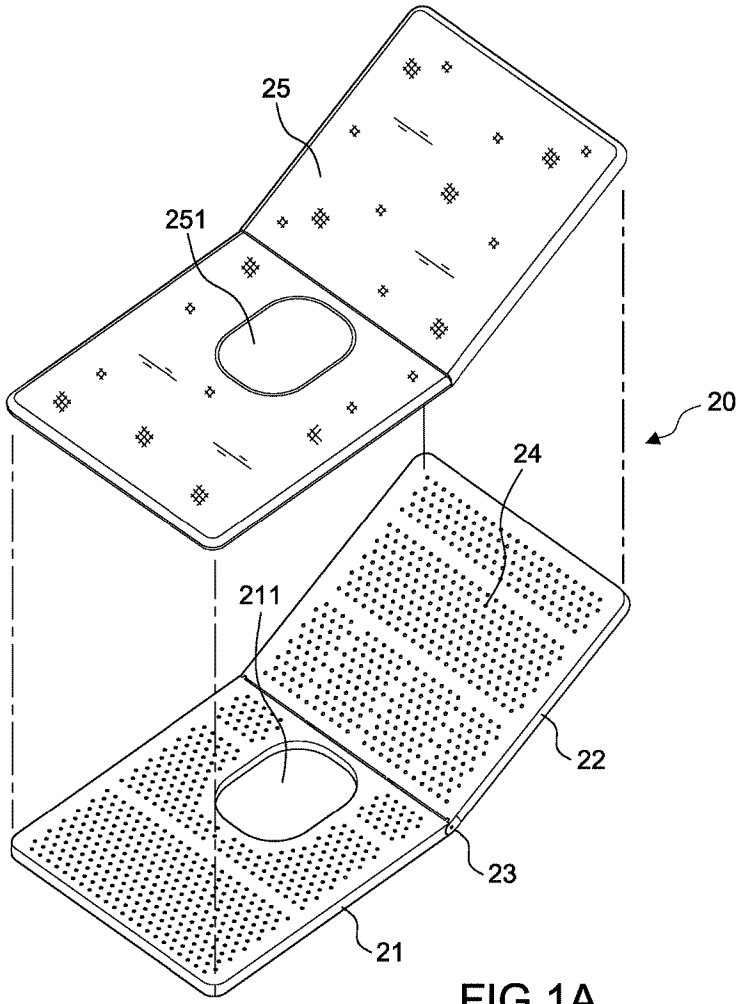
FIG. 1A is an exploded view of a mattress and a board thereof in FIG. 1.

Referring to FIGS. 1-13, in a preferred embodiment, the present invention comprises a bed frame 10, a board 20, a first elevation device 30A, a second elevation device 30B, an excretion device 40, a washing device 50, an anti-splash device 60, a cover device 70, two driver assemblies 80, and a control device 90.

The bed frame 10 includes a head board 12 connecting a foot board 11 with a plurality of side supports 13 in-between. The side supports 13 can be horizontally or vertically arranged.

The board 20 is disposed on the bed frame 10 between the head board 12 and the foot board 11. It includes at least one first panel 21 and one second panel 22; at both ends of an abutting side of the first and second panels 21, 22, a rotatable linkage point 23 is arranged for angle adjusting between the first and second panels 21, 22. In this embodiment, the board 20 has a plurality of ventilation holes 24 with a mattress 25 made of air-permeable materials placed thereon. Under the board 20 at least one fan 26 is arranged for ventilation.

The first elevation device 30A is disposed under the first panel 21 for supporting and adjusting an elevation thereof. In this embodiment, the device includes two pairs of elevation bar 31 and a third threaded rod 34. Each pair of the elevation bar 31 includes a crossed assembly of a first bar 311 and a second 312 bar, symmetrically connected to the first panel 21 from under. The first bar 311 has a top end thereof fixed to the first panel 21 and a bottom end thereof fixed to the side supports 13 of the bed frame 10, and the second bar 312 has a top end thereof fixed to the first panel 21 and a bottom end thereof fixed to a first transverse rod 32 that links to a first nut 33 in the middle thereof. The third threaded rod 34 has an end thereof screwing with the first nut 33 and the other end thereof connected to a fourth motor 35 to be driven and therefore displace the first transverse rod 32, thereby control the elevation and descending of the first panel 21.

The second elevation device 30B is disposed under the second panel 22 for supporting and adjusting an elevation thereof and an angle between the first and second panels 21, 22. In this embodiment, the second elevation device 30B includes two support rods 36 and a fourth threaded rod 39. The support rods 36 are symmetrically connected to the second panel 22 from under; each has a top end thereof fixed to the second panel 22 and a bottom end thereof fixed to a second transverse rod 37 that engages a second nut 38 in the middle thereof. The fourth threaded rod 39 has an end thereof screwing with the second nut 38 and the other end thereof connected to a fifth motor 391 to be driven and therefore displace the second transverse rod 37, thereby control the elevation and descending of the second panel 22.

Figure 11A:
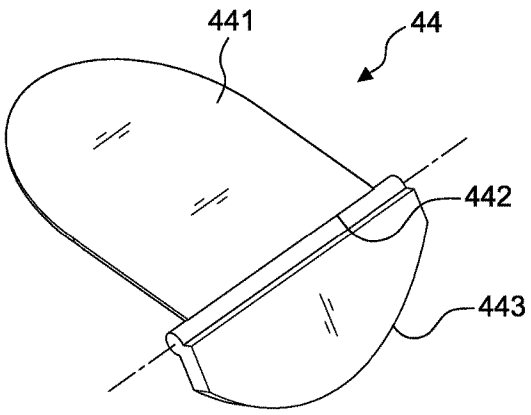
FIG. 11A is a perspective view of a seesaw device thereof.
Figure 11:
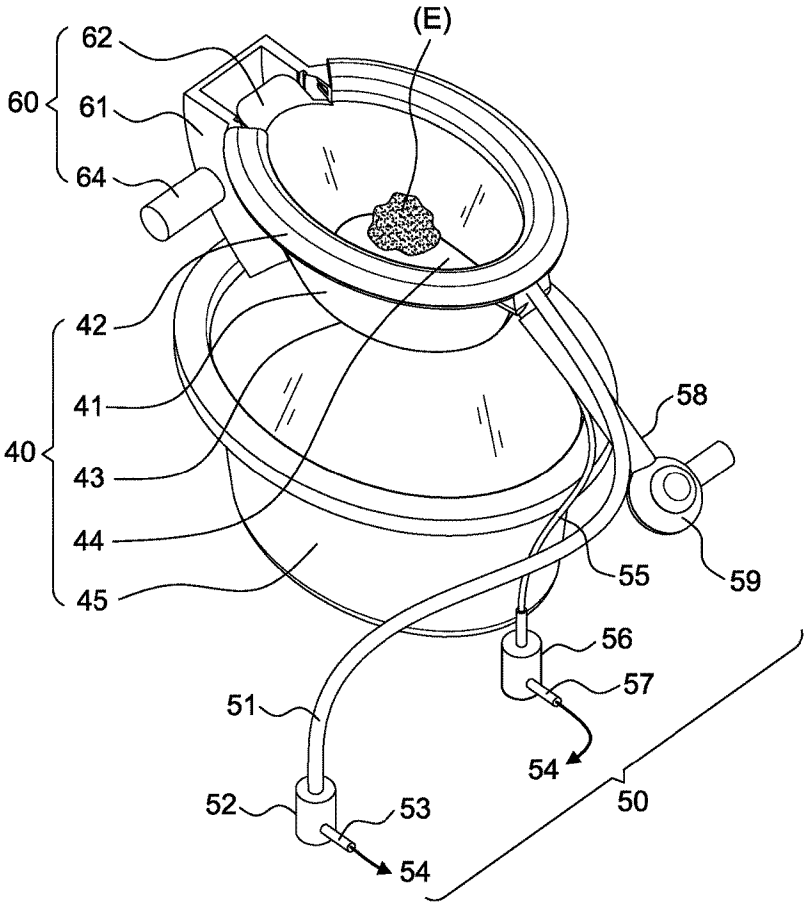
FIG. 11 is a perspective view of an excretion device thereof in a preferred embodiment.
Figure 12:
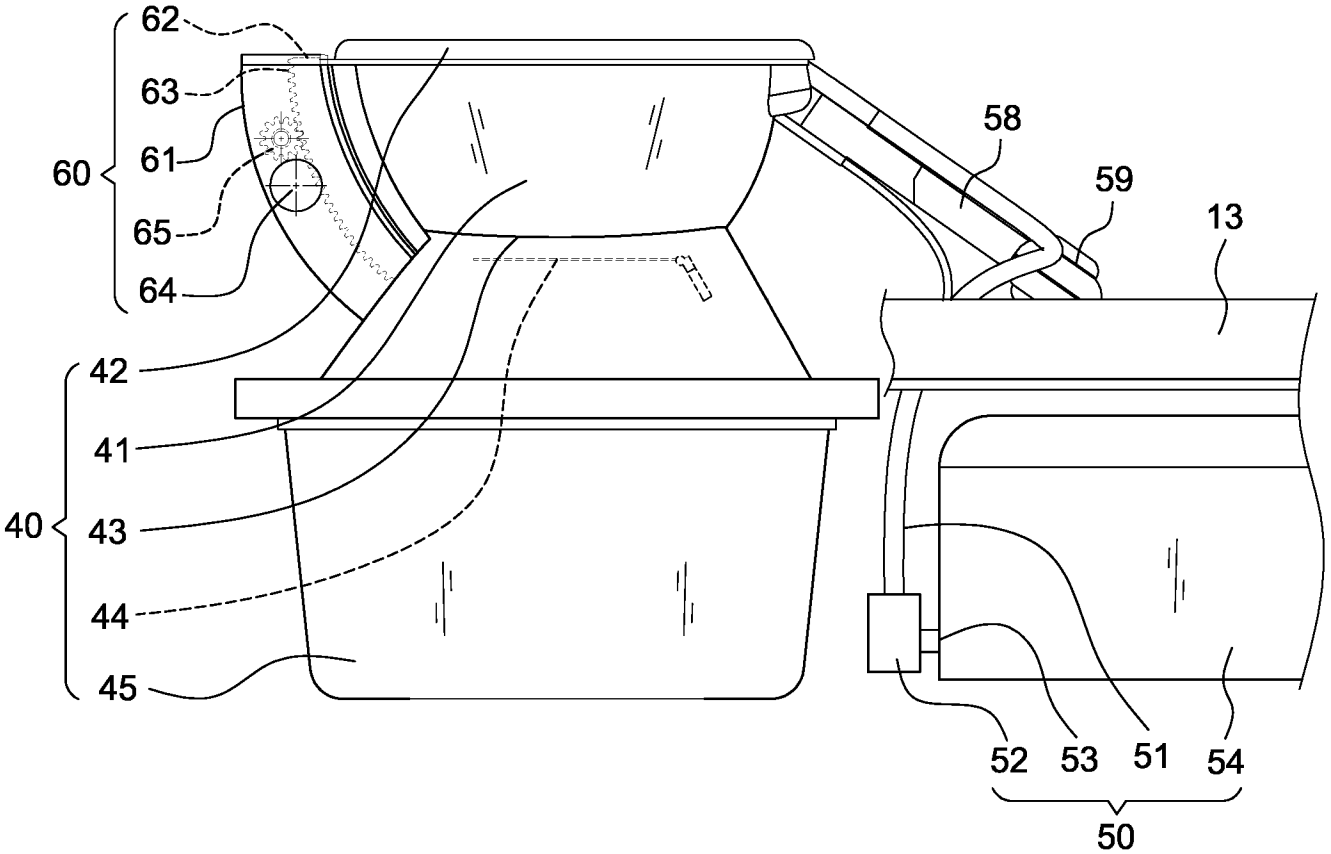
FIG. 12 is a side elevation view of a toilet assembly of the present invention, showing the front thereof descending.
Figure 13:
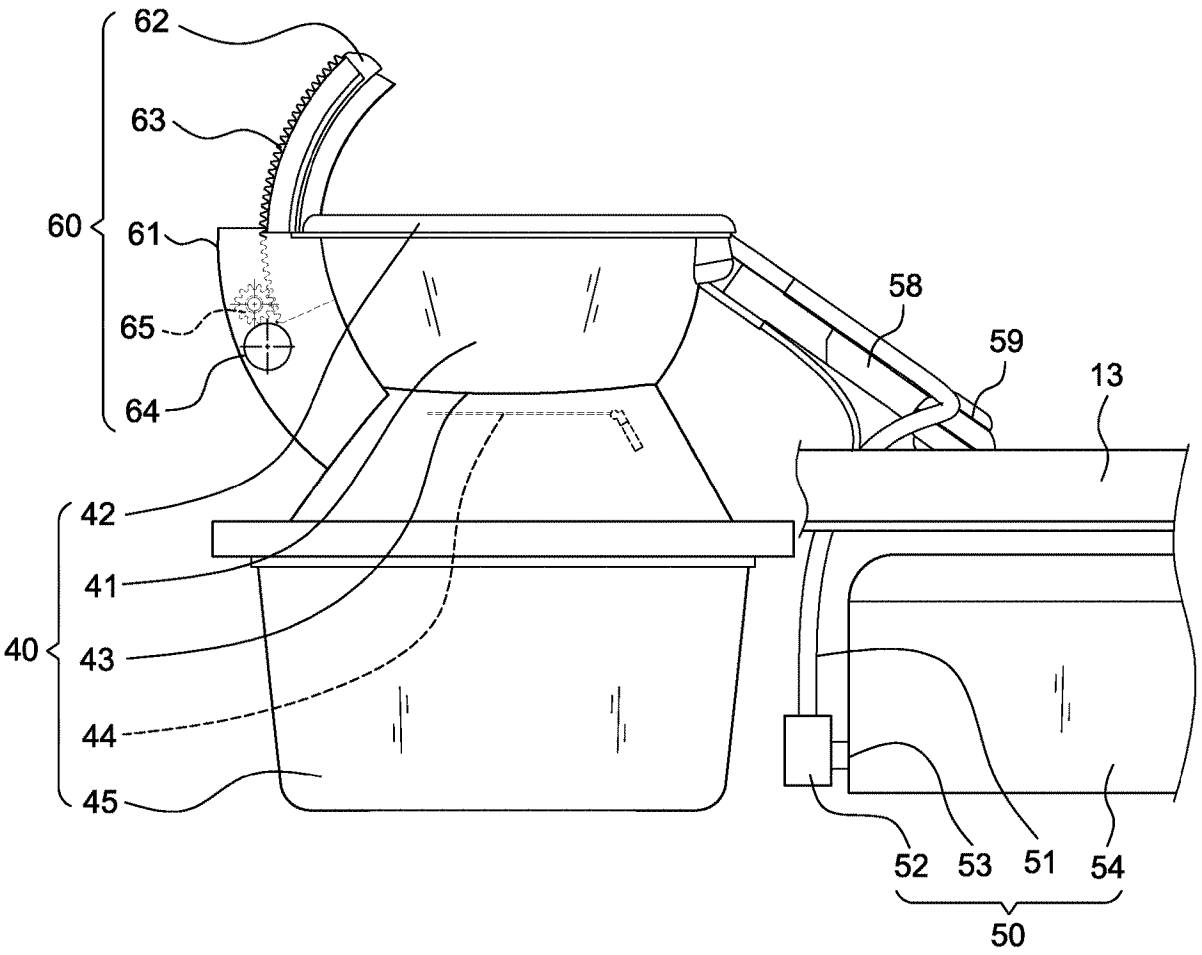
FIG. 13 is a side elevation view of a toilet assembly of the present invention, showing the front thereof elevating.

The features of the present invention are described as following. The first panel 21 includes a first through hole 211 corresponding to a position of buttocks of human body. The excretion device 40 is arranged below the first through hole 211, including a basin 41, a seat pad 42 disposed on a surface of the basin 41, and a detachable container 45 disposed below the basin 41 for taking the falling wastes E. In this embodiment, the basin 41 has an exit 43 at the center thereof with a seesaw device 44 arranged thereunder. Further referring to FIG. 11A, the seesaw device 44 includes a movable board 441 linked to a counterweight 443 by a pivot 442 arranged at a rear periphery of the exit 43 to keep the exit 43 closed in normal status and to guide the wastes E falling down to the container 45 when needed.

Furthermore, the washing device 50 includes a first tube 51 connecting to the excretion device 40 with an end and to a first pump 52 with the other end. The first pump 52 includes a first suction tube 53 to suck in water from a tank 54 for washing the excretion device 40. In this embodiment, the washing device 50 further includes a second tube 55 and an air tube 58. The second tube 55 has an end thereof linked to the excretion device 40 and the other end thereof linked to a second pump 56. The second pump 56 links to a second suction tube 57 to suck in water from the tank 54 for washing the excretion device 40, and the air tube 58 has an end thereof linking to the excretion device 40 and the other end thereof linking to a dryer 59 for drying.

The anti-splash device 60 is disposed at a front of the excretion device 40, including a placing space 61, an anti-splash cover 62 disposed in the placing space 61 with a gear rack 63 arranged behind for operation, and a first motor 64 arranged aside said placing space 61 for driving a gear 65 that engages said gear rack 63 for elevation and descending.

The cover device 70 is arranged between the excretion device 40 and the first panel 21, including a cover 71 disposed above the seat pad 42 and composed of a left board 71L and a right board 71R, a first sliding rail 72, and a second sliding rail 73. The sliding rails 72, 73 are parallel arranged and respectively fixed at a front and a rear side of the cover by an engaging element 711 for the left and right boards 71L, 71R to slide along the first and second sliding rails 72, 73 to combine with and detach from each other. At both ends of the sliding rails 72, 73, a vertical guiding rod 74 is engaged with a spring 75 in-between and the other end devoid of spring 75 stretches through the side supports 13 for elastically elevation of the washing device 50 and for pressing and lowering the cover device 70 to a position where the cover 71 being in the first through hole 211 when the board 10 descends. In this embodiment, the left and right boards 71L, 71R each has a concave surface 712 for disposing diapers (not shown).

The driver assemblies 80 are symmetrically arranged at corresponding far sides of the first and second sliding rails 72, 73, respectively including a second motor 81 and a third motor 82 for respectively driving a first threaded rod 811 and a second threaded rod 821, on each of which a nut 812, 822 is arranged for respectively engaging and driving the right board 71R and the left board 71L.

The control device 90 is individually connected to the first elevation device 30A, the second elevation device 30B, the first pump 52, and the first, second and third motors 64, 81, 82, and has an operation interface for operation control. In this embodiment, the control device 90 is disposed in a pre-determined position on the side supports 14 of the bed frame 10 as shown in FIGS. 2 and 3.

Figure 2:
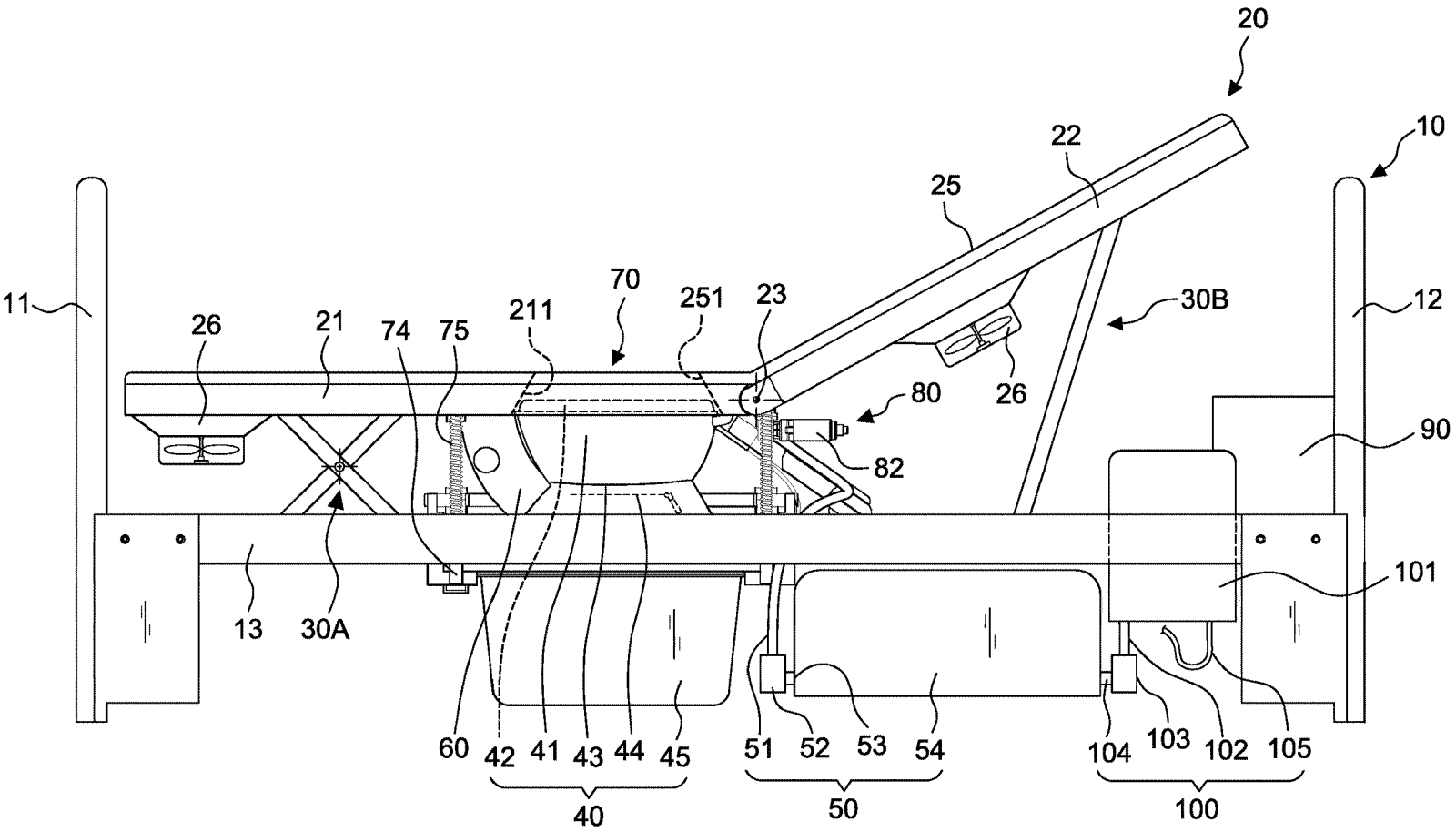
FIG. 2 is a side elevation view of the present invention in a preferred embodiment.
Figure 3:
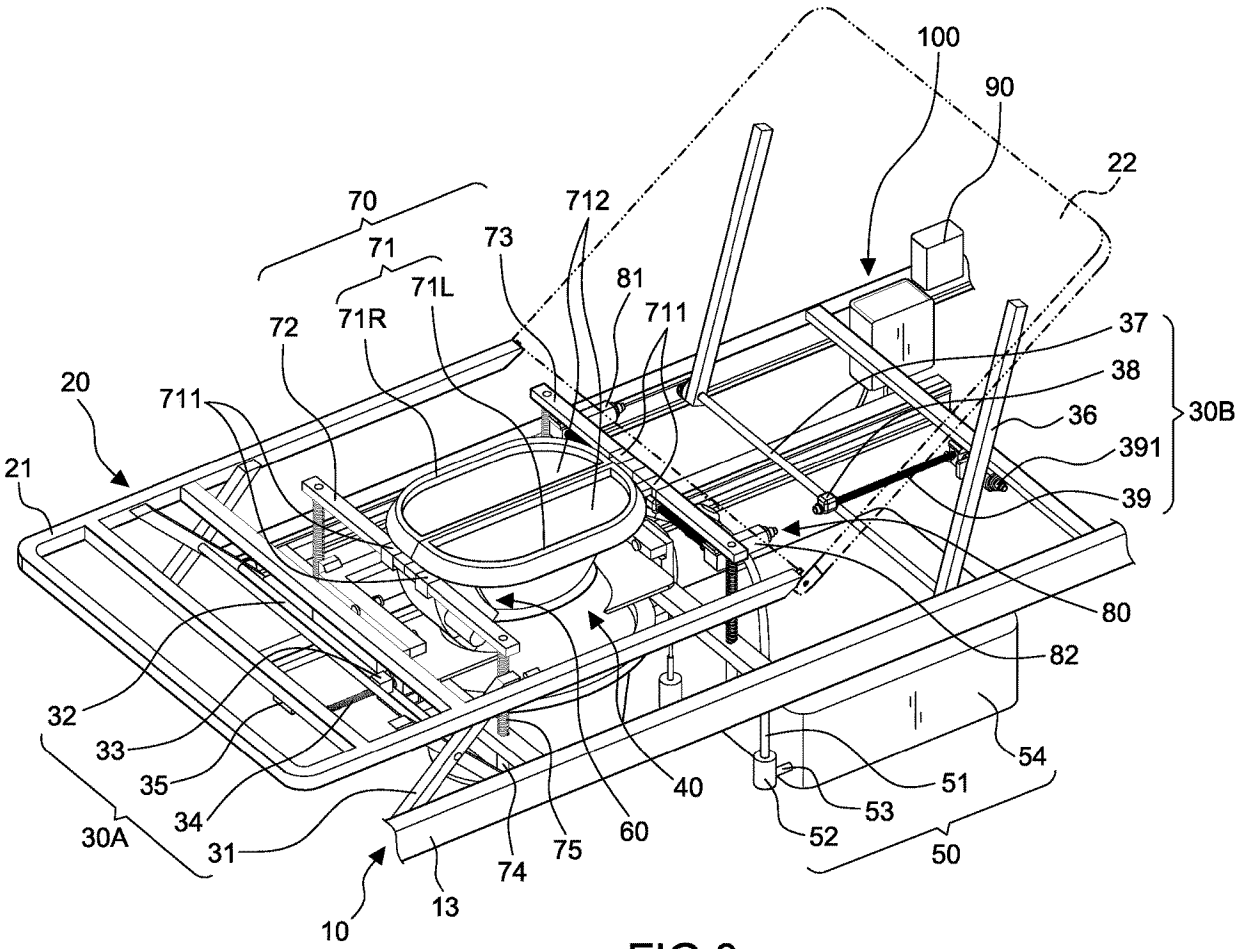
FIG. 3 is a perspective view of major components of the present invention in a preferred embodiment viewing from a slant angle.
Figure 3A:
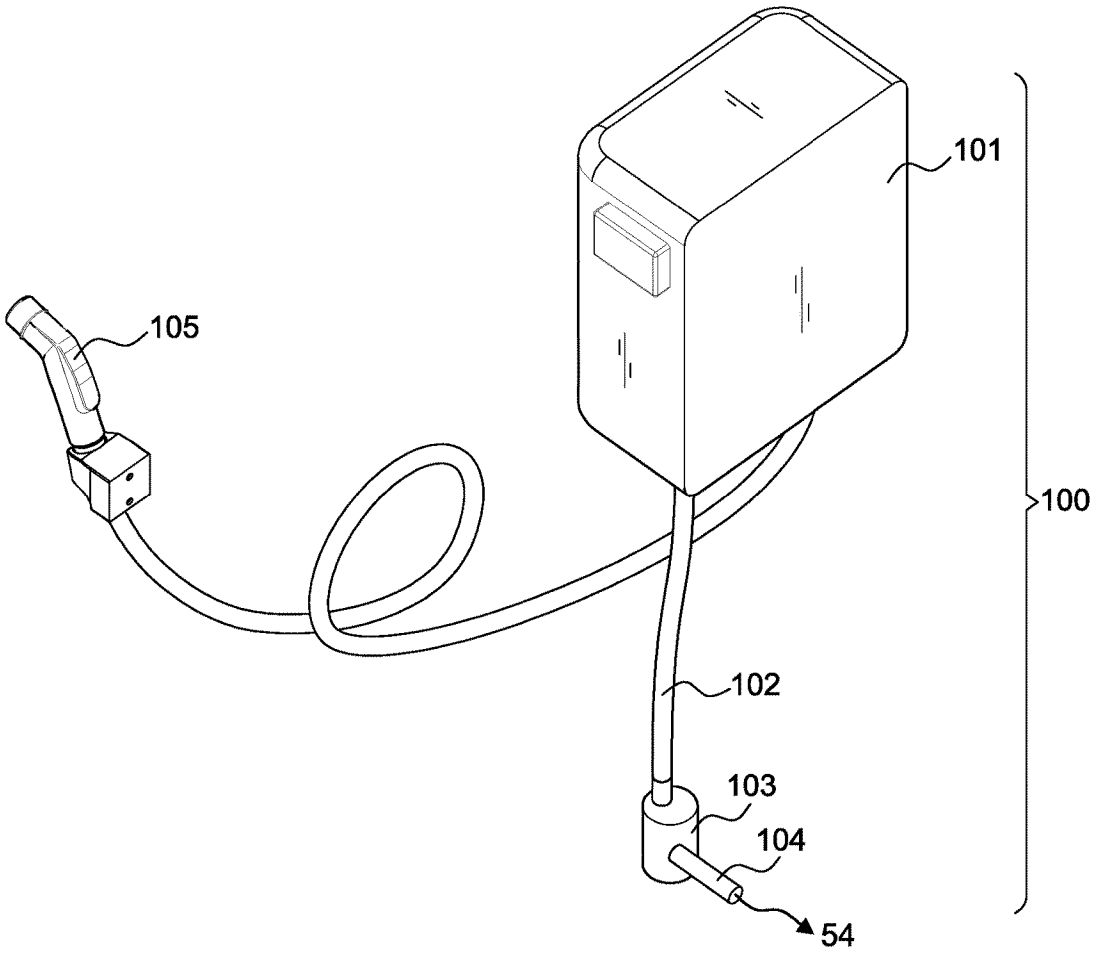
FIG. 3A is a perspective view of an electrical heater thereof in FIG. 3.
Figure 4:
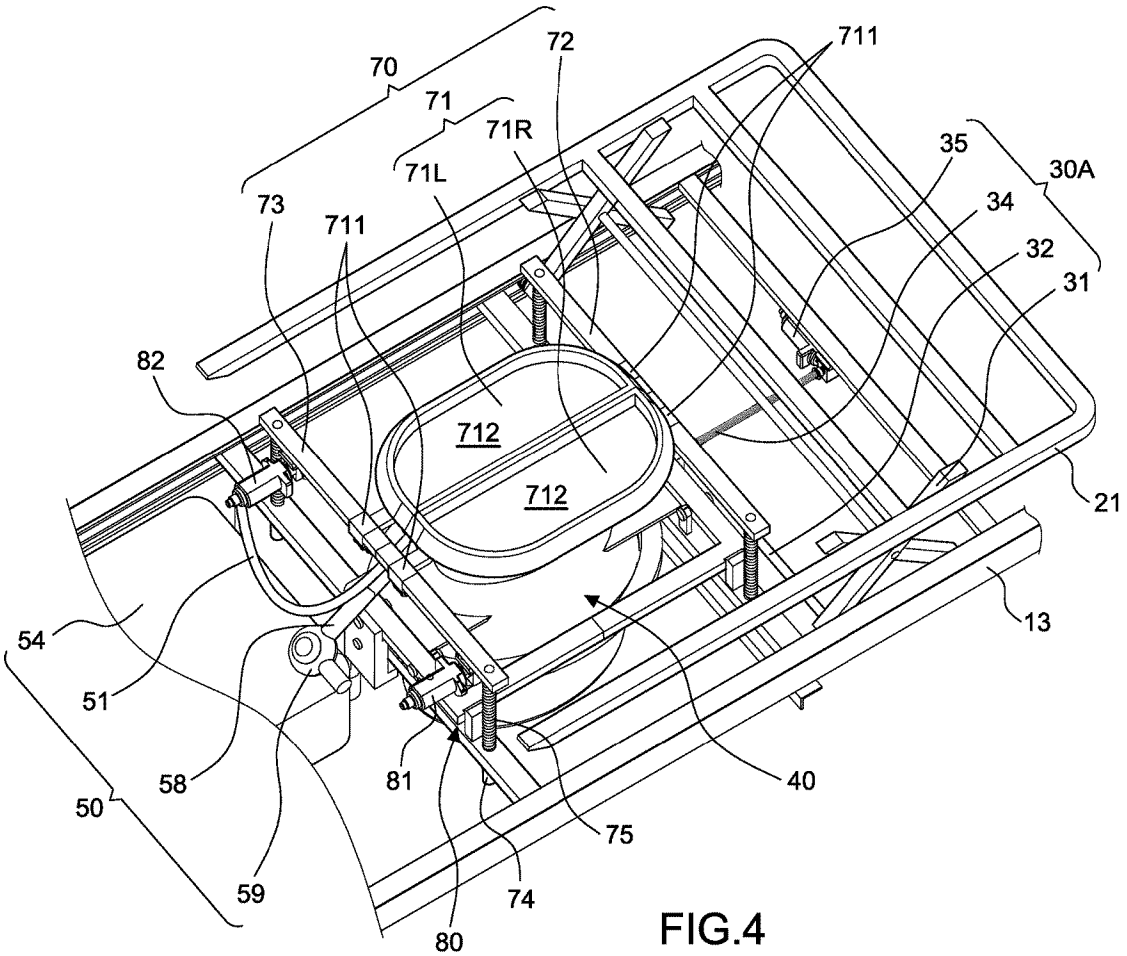
FIG. 4 is a perspective view of major components of the present invention in a preferred embodiment viewing from another slant angle.
Figure 5:
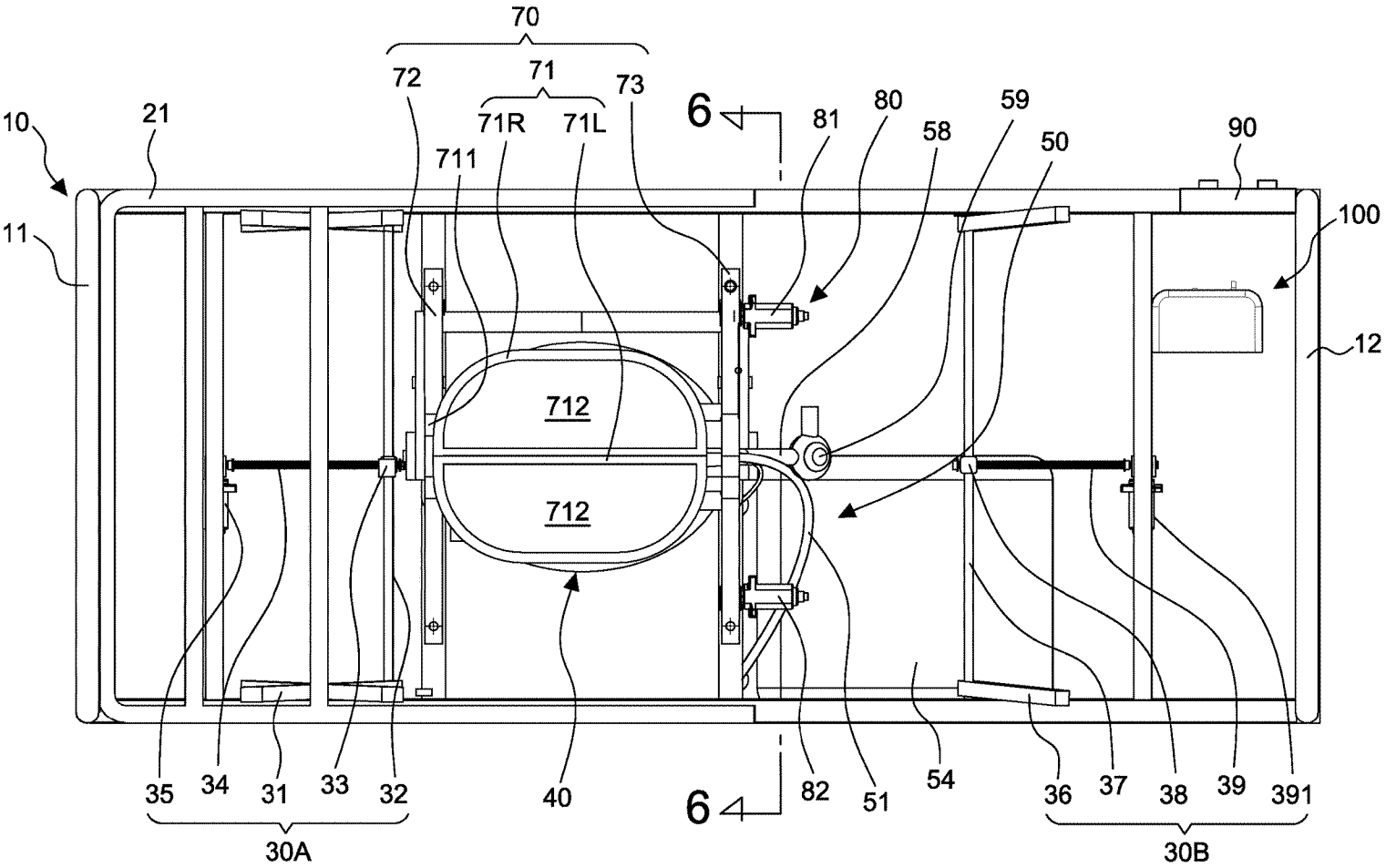
FIG. 5 is a top plan view of the present invention in a preferred embodiment.
Figure 6:
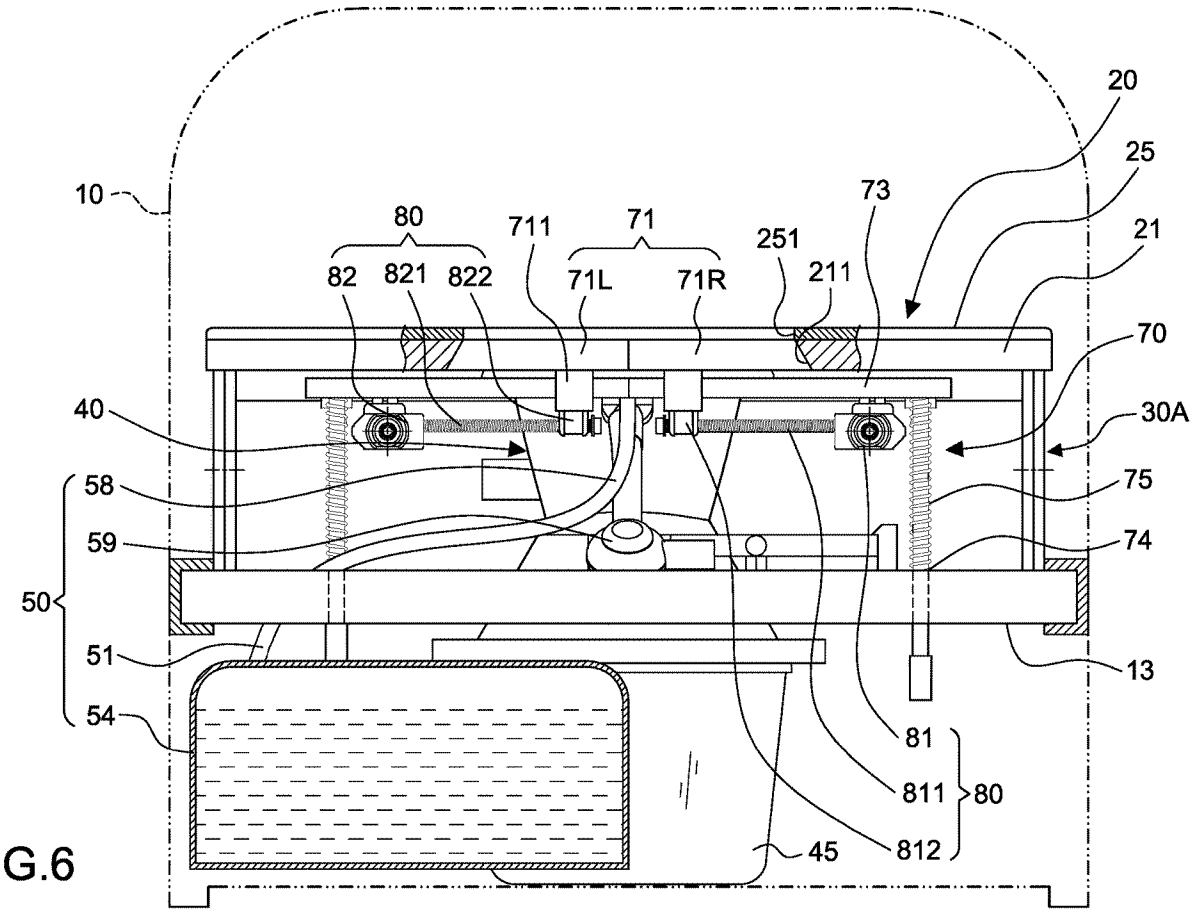
FIG. 6 is a sectional view along line 6-6 in FIG. 5.
Figure 7:
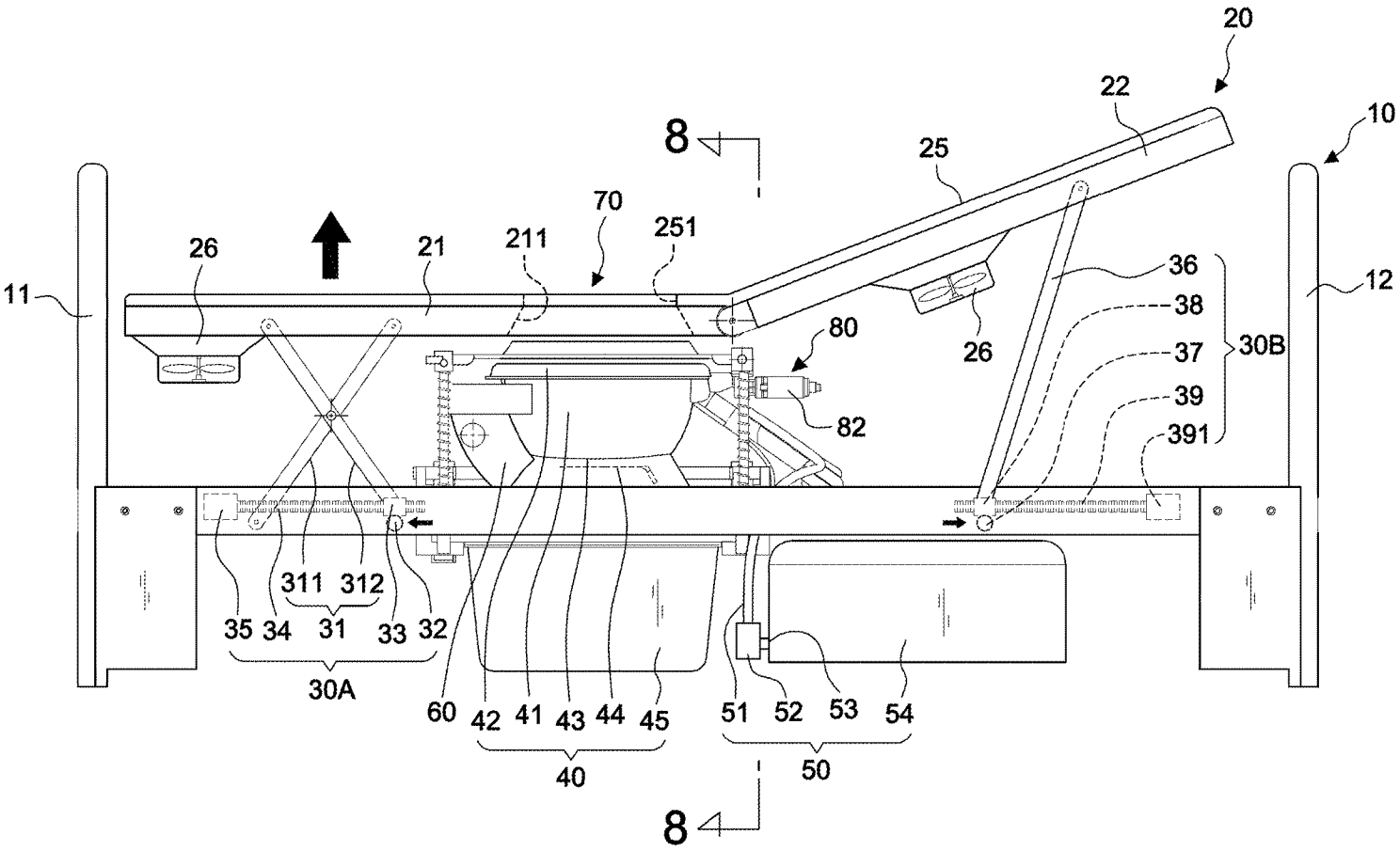
FIG. 7 is a side elevation view of the present invention in a preferred embodiment illustrating a mattress and a board thereof being elevated.
Figure 8:
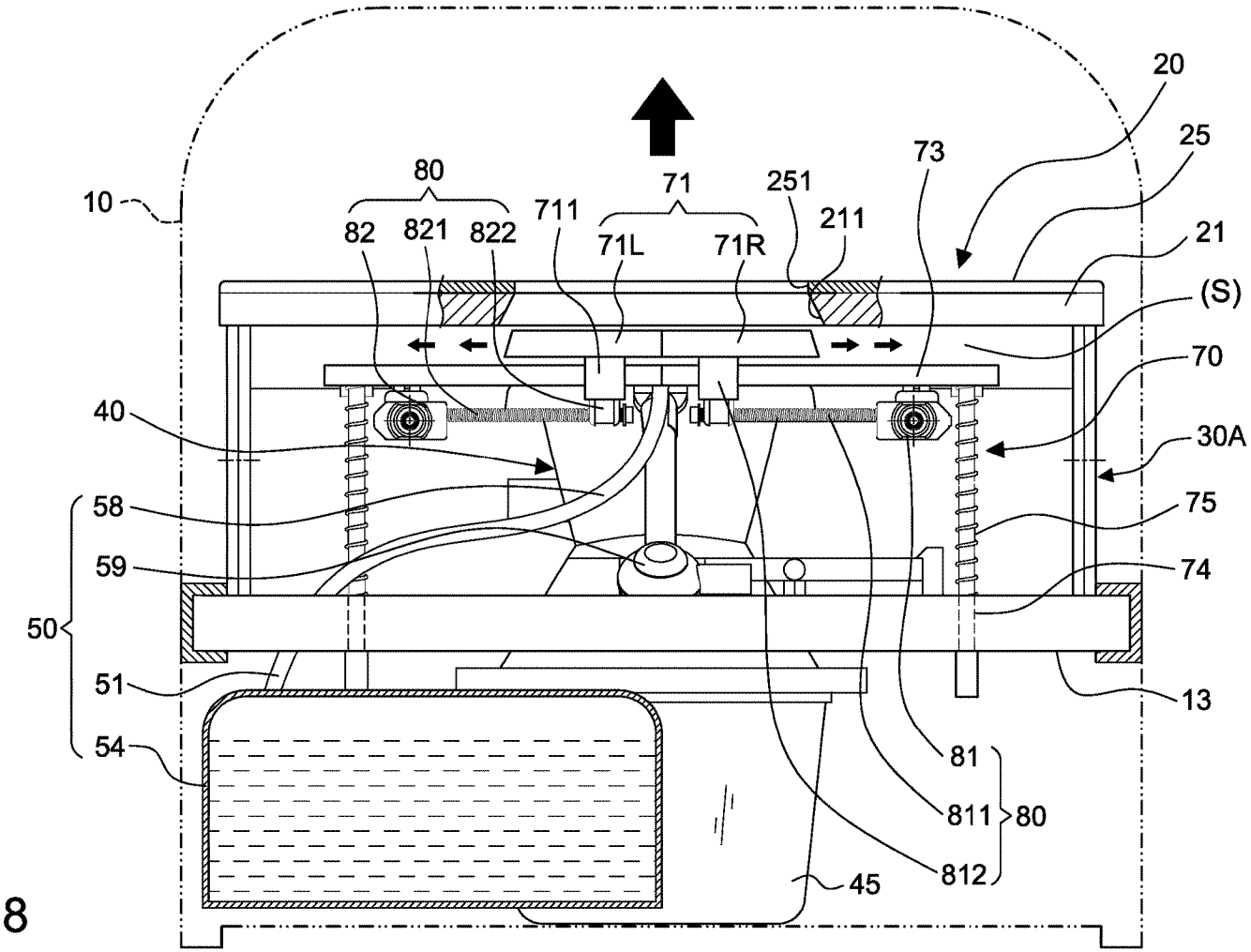
FIG. 8 is a sectional view along line 8-8 in FIG. 7.

Further referring to FIGS. 2-3A, in the embodiment the present invention further comprises an electrical heater 100 arranged on the side supports 13, including a body 101 linked to an end of a third tube 102 and a showerhead 105, and the other end of the third tube 102 is linked to a third pump 103 with a third suction tube 104 for sucking in water from the tank 54 and heating up the water before discharging from the showerhead 105.

Figure 14:
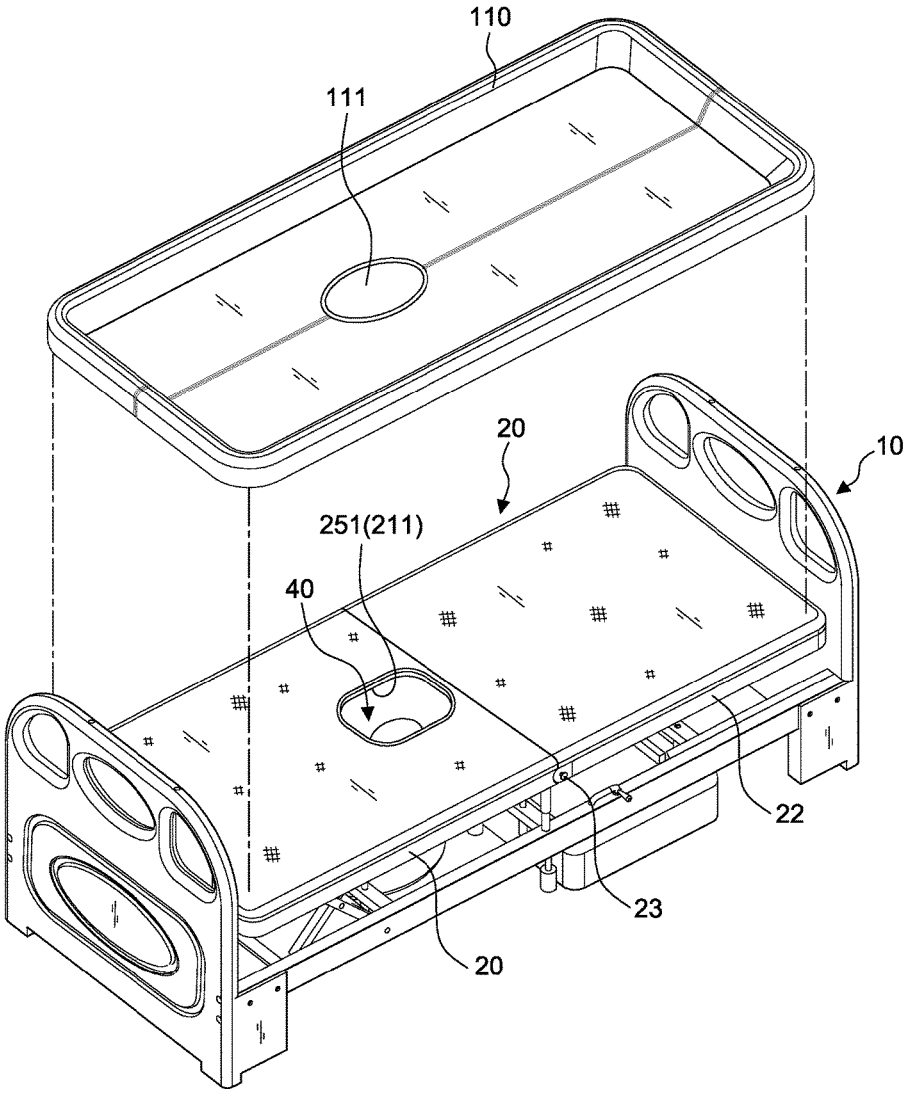
FIG. 14 is an exploded view of the present invention in an applicable embodiment.
Figure 15:
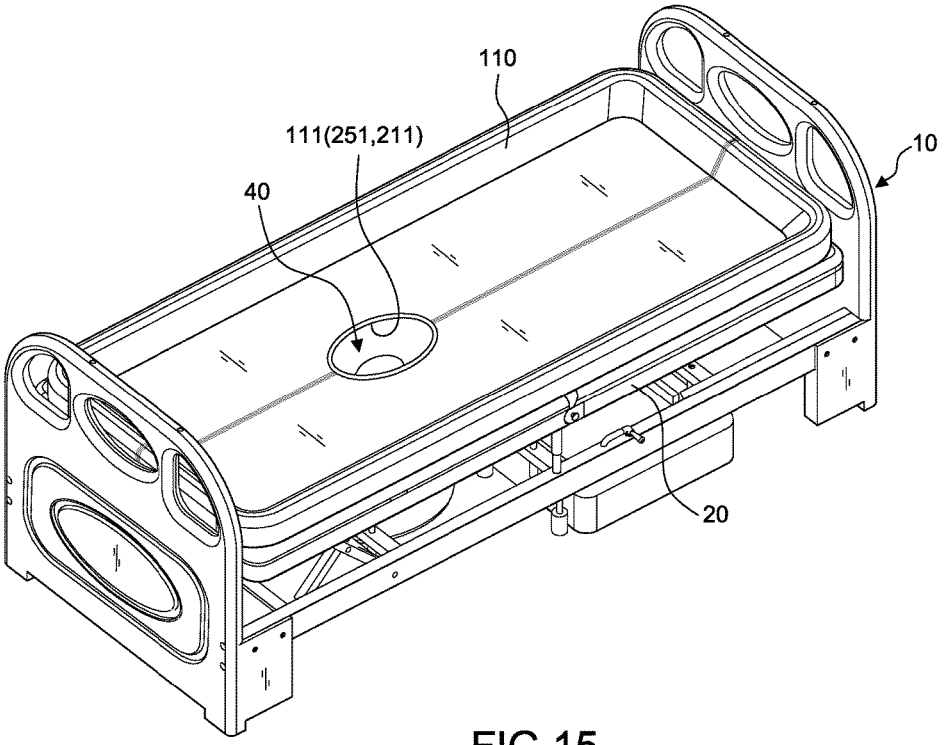
FIG. 15 is a perspective view of FIG. 14.

FIGS. 14 and 15 illustrated the present invention in an applicable embodiment, in which the present invention further includes a tub 110 to be disposed on the board 20 and having a third through hole 111 corresponding to the first and second through holes 251, 211. In this embodiment, the tube 110 is made of waterproof materials with extension.

Figure 16A:
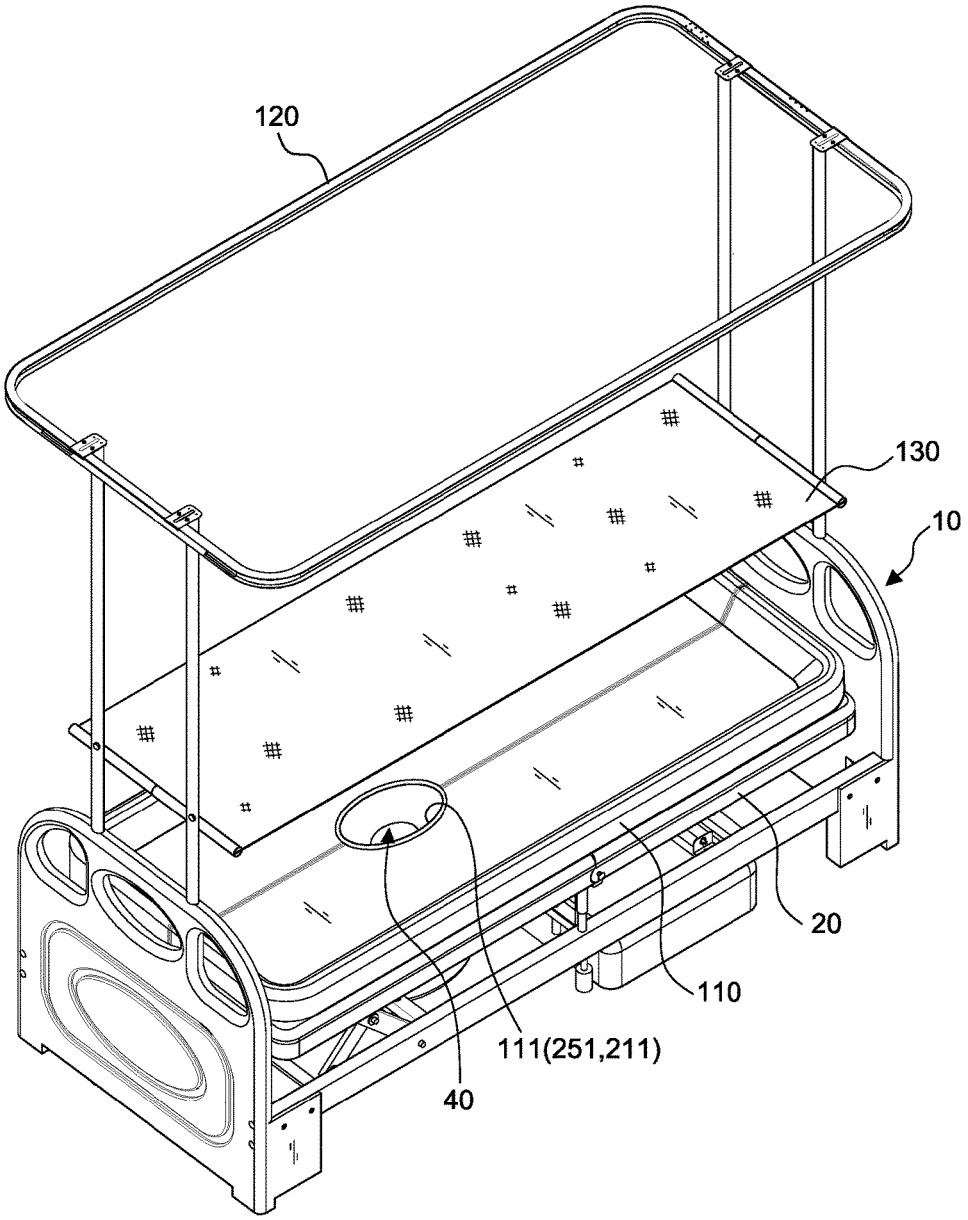
FIG. 16A is a perspective view of the present invention in another applicable embodiment.
Figure 16B:
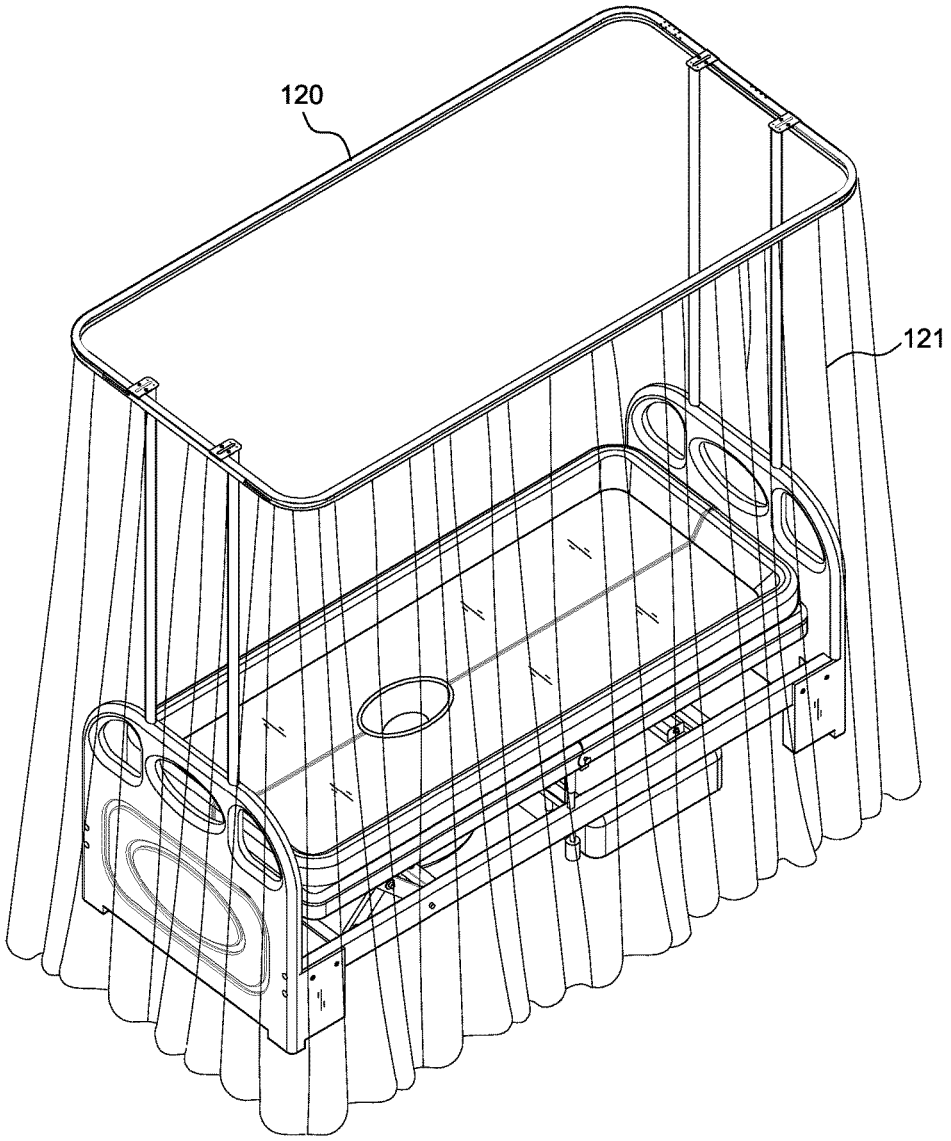
FIG. 16B is an application example of FIG. 16A.

FIGS. 16A and 16B are schematic diagrams of the present invention in another applicable embodiment, in which the present invention further includes a shower frame 120 disposed on the bed frame 10 for a shower curtain 121 to be hung around for bathing. The shower frame 120 also allows a temporary hammock 130 to be placed therein for a user to lie on temporarily while preparing the tub 110 for bathing.

Figure 17A:
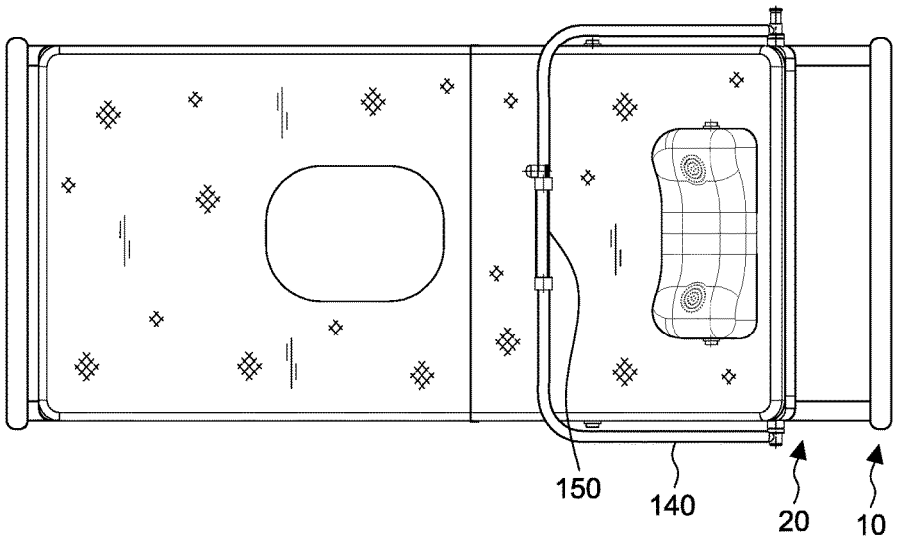
FIG. 17A is a top plan view of the present invention in another applicable embodiment.
Figure 17B:
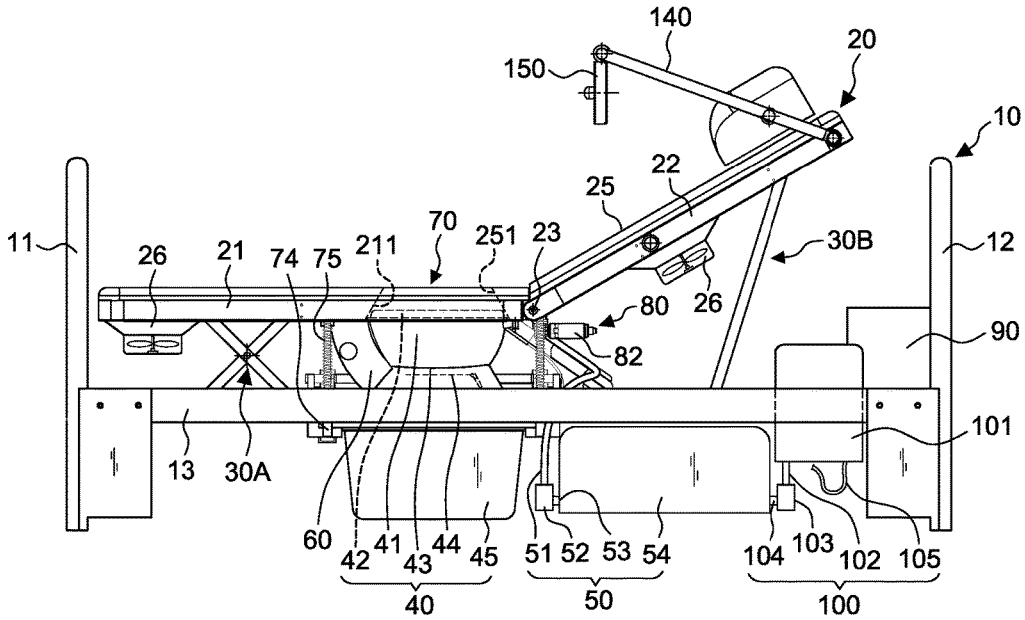
FIG. 17B is a side elevation view of FIG. 17A.

FIGS. 17A and 17B are schematic diagrams of the present invention in yet another applicable embodiment, in which the present invention further includes an adjustable U frame 140 disposed on the second panel 22 of the board 20 for installing a TV screen 150 thereon to play TV programs, be connected with a computer, and be a monitor.

In conclusion, the present invention has features as below. Firstly, as shown in FIG. 1, under normal status the left and right boards 71L, 71R are combined and closed, hiding the excretion device 40 under the first panel 21 for environment hygiene concerns. Also, with the concave surfaces 712 on the left and right boards 71L, 71R and the ventilation holes 24 on the board 20 for the air to pass through, the nursing bed offers a space for diapers (not shown) and ventilated bed for its user, making it as comfortable as any nursing bed would be.

Figure 9:
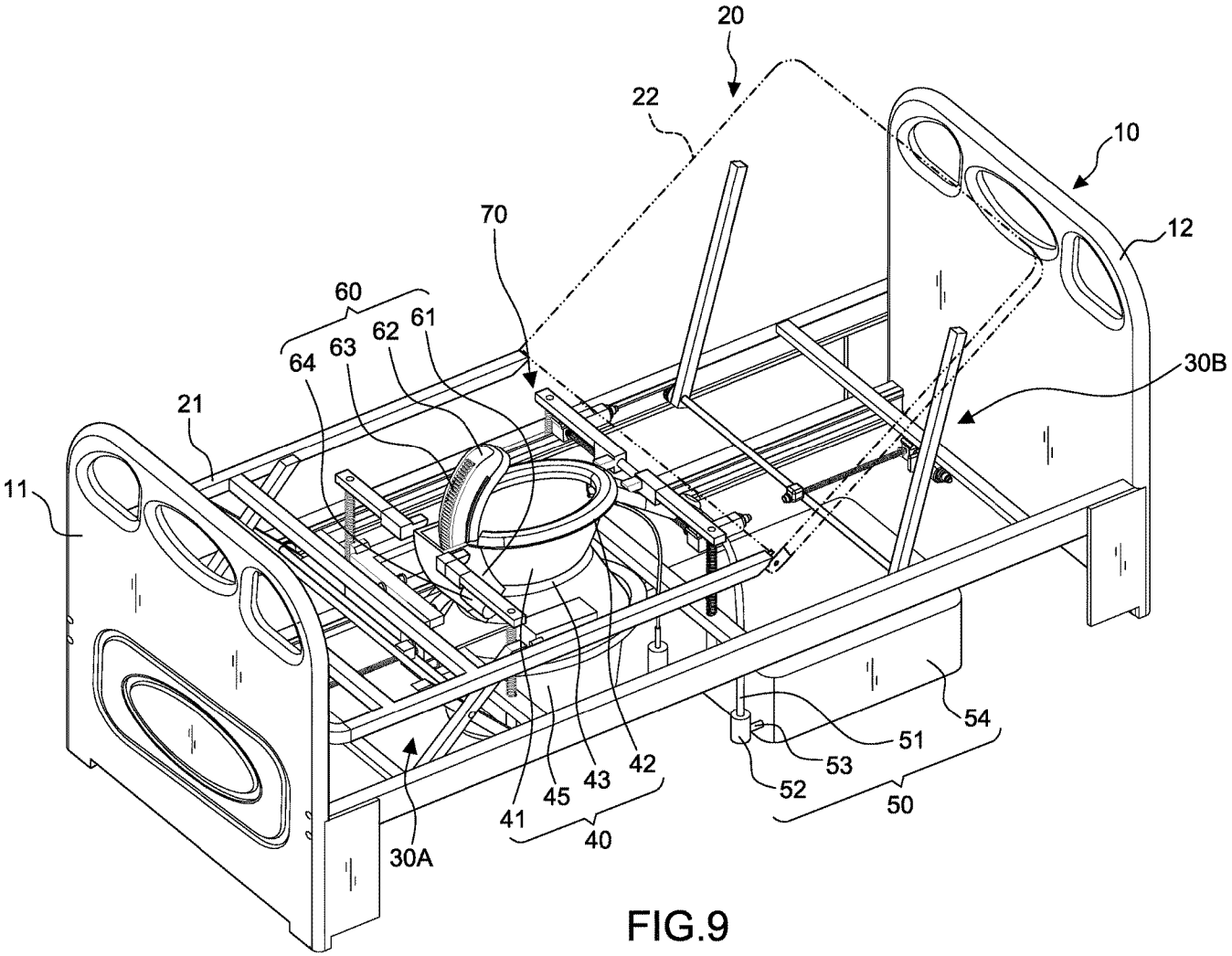
FIG. 9 is a schematic diagram illustrating an excretion device being operated in a preferred embodiment.
Figure 10:
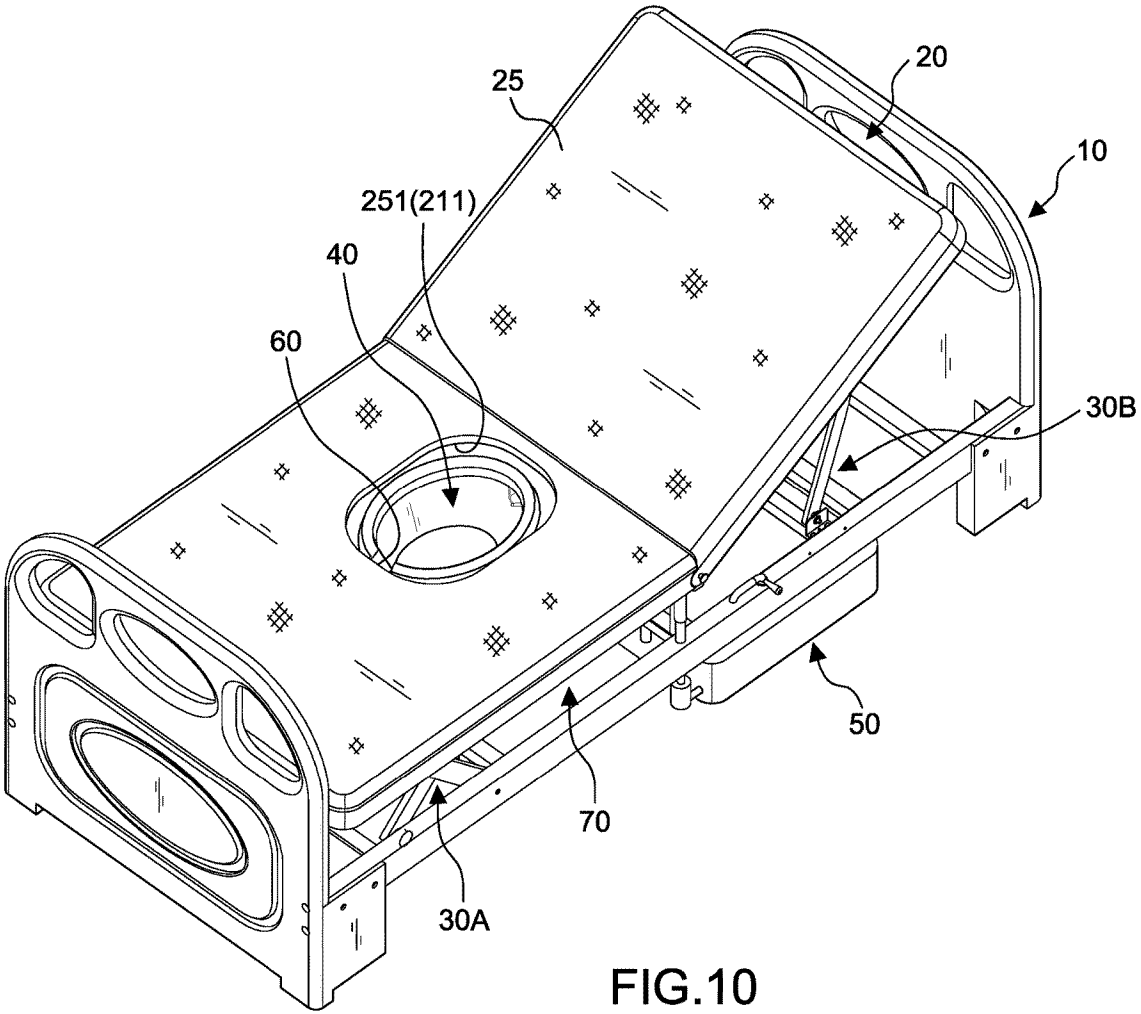
FIG. 10 is a perspective view of the present invention in a preferred embodiment illustrating an excretion device being operated.

Secondly, when its user has a need for excretion, to avoid hurting the user when operating the devices, the present invention would elevate the board 20 by the elevation devices 30A, 30B, counterbalancing the pressing force on the cover device 70 and elevating the guiding rod 74 with the elastic force of the spring 75, further elevating the cover 71 and the sliding rails 72, 73 and placing the cover 71 in a space S between the board 20 and the excretion device 40. Then the driver assemblies 80 would drive the second and the third motors 81, 82 to respectively rotate the first and second threaded rods 811, 821 for detaching the left and right boards 71L, 71R. The board 20 then descends back, pressing and descending the cover device 70 and placing the seat pad 42 of the excretion device 40 under the first and second through holes 211, 251 as shown in FIG. 10; and the anti-splash cover 62 of the anti-splash device 60 is lifted to position and ready for use as shown in FIG. 9.

Thirdly, upon wastes E falling down to the basin 41, the movable board 441 of the seesaw device 44 inclines due to the weight, further causing the wastes E falling down to the container 45 via the exit 43. Then the washing machine 50 operates to wash the excretion device 40 via the first tube 51 and the buttock of the user via the second tube 55, and then dries with the air tube 58 linking to the dryer 59, ensuring cleanness and hygiene.

Therefore, the present invention is designed for those have to lie on a bed for most of the time, usually patients. With the features disclosed above, the user is able to perform excretion and bathe with more conveniences without relying on others' helps, therefore regaining some self-esteem as well. Also, such invention helps with better hygiene.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A multifunctional nursing bed for excretion, comprising:

a bed frame including a head board connecting a foot board with a plurality of side supports in-between;

a board disposed on the bed frame between the head board and the foot board, including at least one first panel and one second panel, both ends of an abutting side of said first and second panels having a rotatable linkage point for angle adjusting between the first and second panels;

a first elevation device disposed under the first panel for supporting and adjusting an elevation of the first panel;

a second elevation device disposed under the second panel for supporting and adjusting an elevation of the second panel and an angle between the first and second panels;

wherein the first panel includes a first through hole corresponding to a position of buttocks of human body;

an excretion device arranged below the first through hole, including a basin, a seat pad disposed on a surface of the basin, and a detachable container disposed below the basin for taking the falling wastes;

a washing device including a first tube connecting to said excretion device with an end and to a first pump with the other end, said first pump including a first suction tube to suck in water from a tank for washing the excretion device;

an anti-splash device disposed at a front of the excretion device, including a placing space, an anti-splash cover disposed in said placing space with a gear rack arranged behind for operation, and a first motor arranged aside said placing space for driving a gear that engages said gear rack for elevation and descending;

a cover device arranged between the excretion device and the first panel, including a cover disposed above the seat pad and composed of a left board and a right board, a first sliding rail, and a second sliding rail; said sliding rails being parallel arranged and respectively fixed at a front and a rear side of the cover by an engaging element for the left and right boards to slide along the first and second sliding rails to combine with and detach from each other; at both ends of said sliding rails, a vertical guiding rod being engaged with a spring in-between and the other end devoid of the spring stretching through the side supports for elastically elevating the washing device and for pressing and lowering said cover device to a position where the cover being in the first through hole when the board being descended;

two driver assemblies symmetrically arranged at corresponding far sides of the first and second sliding rails, respectively including a second motor and a third motor for respectively driving a first threaded rod and a second threaded rod, on each of which a nut is arranged for respectively engaging and driving the right board and the left board; and a control device individually connected to the first elevation device, the second elevation device, the first pump, and the first, second and third motors, and having an operation interface for operation control;

whereby upon a patient on the nursing bed having a need for excretion, the control device drives the first and second elevation devices to elevate the board and the cover device is elevated as well, then the board descends back to an original position after the cover of the cover device is opened, pressing the cover device for descending and placing the seat pad of the excretion device right under the first through hole with the anti-splash cover of the anti-splash device elevated for being ready for use.

2. The multifunctional nursing bed for excretion as claimed in claim 1, wherein the board has a plurality of ventilation holes with a mattress made of air-permeable materials placed thereon, said mattress including a second through hole corresponding to the first through hole on the first panel of the board; and at least one fan is arranged under the board for ventilation.

3. The multifunctional nursing bed for excretion as claimed in claim 1, wherein the first elevation device includes two pairs of elevation bar, each pair including a crossed assembly of a first bar and a second bar and being symmetrically connected to the first panel from underneath, said first bar having a top end thereof fixed to the first panel and a bottom end thereof fixed to the side supports of the bed frame, and said second bar having a top end thereof fixed to the first panel and a bottom end thereof fixed to a first transverse rod that links to a first nut in the middle thereof; a third threaded rod has an end thereof screwing with said first nut and the other end thereof connected to a fourth motor to be driven and therefore displace the first transverse rod, thereby controlling the elevation and descending of the first panel.

4. The multifunctional nursing bed for excretion as claimed in claim 1, wherein the second elevation device includes two support rods symmetrically connected to the second panel from underneath, said support rods having a top end thereof fixed to the second panel and a bottom end thereof fixed to a second transverse rod that engages a second nut in the middle thereof; a fourth threaded rod has an end thereof screwing with said second nut and the other end thereof connected to a fifth motor to be driven and therefore displace the second transverse rod, thereby controlling the elevation and descending of the second panel.

5. The multifunctional nursing bed for excretion as claimed in claim 1, wherein the basin of the excretion device has an exit at the center thereof with a seesaw device arranged thereunder, said seesaw device including a movable board linked to a counterweight by a pivot arranged at a rear periphery of the exit to keep the exit closed in normal status and to guide the wastes falling down to the container when needed.

6. The multifunctional nursing bed for excretion as claimed in claim 1, wherein the washing device further includes a second tube that has an end thereof linked to the excretion device and the other end thereof linked to a second pump, said second pump linking to a second suction tube to suck in water from the tank for washing the excretion device, and an air tube having an end thereof linking to the excretion device and the other end thereof linking to a dryer for drying.

7. The multifunctional nursing bed for excretion as claimed in claim 1, further comprising an electrical heater arranged on the side supports, including a body linked to an end of a third tube and a showerhead, and the other end of the third tube is linked to a third pump with a third suction tube for sucking in water from the tank and heating up the water before discharging from the showerhead.

8. The multifunctional nursing bed for excretion as claimed in claim 2, further including a tub to be disposed on the board and having a third through hole corresponding to the first and second through holes.

9. The multifunctional nursing bed for excretion as claimed in claim 8, further including a shower frame disposed on the bed frame for a shower curtain to be hung around; said shower frame also allows a temporary hammock to be placed therein.

10. The multifunctional nursing bed for excretion as claimed in claim 2, further including an adjustable U frame disposed on the second panel of the board for installing a TV screen thereon.

* * * * *